US010948193B2

(12) United States Patent
Christensen Phillips et al.

(10) Patent No.: US 10,948,193 B2
(45) Date of Patent: Mar. 16, 2021

(54) FAN ASSEMBLY FOR AN INDUCTION COOKING APPLIANCE

(71) Applicant: Haier US Appliance Solutions, Inc., Wilmington, DE (US)

(72) Inventors: Charles David Christensen Phillips, Louisville, KY (US); Eric Scott Johnson, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 228 days.

(21) Appl. No.: 16/055,226

(22) Filed: Aug. 6, 2018

(65) Prior Publication Data

US 2020/0041136 A1 Feb. 6, 2020

(51) Int. Cl.

| | |
|---|---|
| ***F24C 15/00*** | (2006.01) |
| ***F24C 15/10*** | (2006.01) |
| *H05B 6/42* | (2006.01) |

(52) U.S. Cl.

CPC ..... *F24C 15/006* (2013.01); *F24C 15/101* (2013.01); *H05B 6/42* (2013.01)

(58) Field of Classification Search

USPC ..... 137/110; 415/101, 102, 55.5, 55.4, 55.7, 415/204, 206

See application file for complete search history.

(56) References Cited

U.S. PATENT DOCUMENTS

| | | | | |
|---|---|---|---|---|
| 1,014,321 A * | 1/1912 | Minor | F04D 29/664 415/119 |
| 2,584,613 A * | 2/1952 | Pledger | F24C 15/2007 126/299 R |
| 2,710,573 A * | 6/1955 | Marker | F24F 13/20 454/354 |
| 2,736,489 A * | 2/1956 | Bopf | A01D 46/10 415/198.1 |
| 3,089,479 A * | 5/1963 | Perl | F24C 15/30 126/21 A |

(Continued)

FOREIGN PATENT DOCUMENTS

| | | |
|---|---|---|
| CN | 101147653 | 3/2008 |
| CN | 201628270 U | 11/2010 |

(Continued)

OTHER PUBLICATIONS

"BMW—Cat 2003.pdf", modular air handler catalogue, United Electric Co. LP, Aug. 2003. (Year: 2003).*

(Continued)

*Primary Examiner* — Daniel E. Namay
(74) *Attorney, Agent, or Firm* — Dority & Manning, P.A.

(57) ABSTRACT

A cooking appliance includes an insulated cooking chamber positioned within a cabinet and an air plenum defined between the cabinet and the insulated cooking chamber. A fan assembly includes a first fan and a second fan positioned adjacent each other and having a void region immediately downstream of their outlets. The fan housings may be positioned in direct contact with each other such that the flows of cooling air exiting each fan interact with each other to reduce or eliminate expansion losses. Alternatively, the fan housings may be separated by a small airgap to reduce expansion losses while entraining additional cooling air.

20 Claims, 7 Drawing Sheets

(56) References Cited

U.S. PATENT DOCUMENTS

| | | | | |
|---|---|---|---|---|
| 3,587,555 | A * | 6/1971 | Cerola | F24C 15/18 126/11 |
| 3,713,401 | A * | 1/1973 | McClurkin | A47J 39/003 432/64 |
| 3,719,137 | A * | 3/1973 | Gould | F24C 15/2042 126/299 D |
| 3,820,525 | A * | 6/1974 | Pond | A21B 2/00 126/21 A |
| 3,874,191 | A * | 4/1975 | Hudson | F04D 17/04 62/426 |
| 4,418,261 | A * | 11/1983 | Jailor | H05B 6/6423 126/21 A |
| 6,257,012 | B1 * | 7/2001 | Tesche | F04D 29/4226 415/204 |
| 6,621,057 | B2 * | 9/2003 | Kim | H05B 6/6423 126/21 A |
| 6,648,590 | B2 * | 11/2003 | Huang | F04D 17/04 415/206 |
| 6,864,472 | B2 | 3/2005 | Kang | |
| 2008/0019825 | A1 * | 1/2008 | Chang | F04D 17/06 415/204 |
| 2010/0098534 | A1 * | 4/2010 | Small | F04D 25/163 415/204 |
| 2017/0257913 | A1 | 9/2017 | Vengroff et al. | |
| 2018/0163975 | A1 * | 6/2018 | Jiang | F24C 15/2042 |
| 2019/0090494 | A1 * | 3/2019 | Mierisch | A21B 1/245 |

FOREIGN PATENT DOCUMENTS

| | | | |
|---|---|---|---|
| CN | 201964478 | U | 9/2011 |
| CN | 104414434 | | 3/2015 |
| CN | 106322454 | | 1/2017 |
| CN | 207122933 | | 3/2018 |
| JP | 61229997 | A * | 10/1986 |
| JP | 2003086340 | | 3/2003 |
| KR | 20060062198 | | 6/2006 |
| KR | 20110082800 | | 7/2011 |

OTHER PUBLICATIONS

International Search Report, PCT No. PCT/CN2019/099413, dated Oct. 24, 2019, 3 pages.

* cited by examiner

FAN ASSEMBLY FOR AN INDUCTION COOKING APPLIANCE

FIELD OF THE INVENTION

The present disclosure relates generally to an oven appliance, or more specifically, to an improved cooling system for an oven appliance.

BACKGROUND OF THE INVENTION

Oven range appliances generally include a cabinet and an insulated cooking chamber disposed therein for receipt of food items for cooking. Heating elements are positioned within the cooking chamber to provide heat to food items located therein. The heating elements can include a bake heating element positioned at a bottom of the cooking chamber, a broil heating element positioned at a top of the cooking chamber, and/or a convection heating assembly. Oven range appliances also frequently include a cooktops having multiple burner assemblies, such as electrical resistance coils, gas burners, or induction heating assemblies.

During operation of such oven appliances, the operation of the heating elements and burner assemblies may generate large amounts of thermal energy within and around the appliance. Oven appliances thus require features for managing the thermal energy generated by the various heating elements and burners. For example, conventional oven appliances define an air plenum between the cabinet and the insulated cooking chamber which houses the appliance controller, heating element junctions, and other electronics that require cooling. In addition, side panels and other surfaces of oven appliances often require significant cooling to meet regulatory standards.

Therefore, conventional oven appliances include cooling systems for managing the flow of heated air and regulating component temperatures. For example, a fan may be positioned within the oven appliance to continuously remove heated air within the air plenum and replenish it with cooler ambient air, thereby cooling the oven electronics and the cabinet housing them. Large fans may be desirable to increase the air flow rate, but are typically costly and take up much of the limited space within the cabinet. Using multiple smaller fans may solve cost and space issues, but may result in poor system efficiency due to expansion losses associated with the discharge of cooling air from multiple outlets.

Accordingly, an oven appliance that provides features for improved thermal management would be useful. More particularly, a compact fan assembly for an oven appliance that efficiently urges cooling air within the cabinet would be especially beneficial.

BRIEF DESCRIPTION OF THE INVENTION

Aspects and advantages of the invention will be set forth in part in the following description, may be apparent from the description, or may be learned through practice of the invention.

In one exemplary embodiment, a cooking appliance defining a vertical direction, a lateral direction, and a transverse direction is provided. The cooking appliance includes a cabinet, an insulated cooking chamber positioned within the cabinet, and an air plenum defined between the cabinet and the insulated cooking chamber. A fan assembly is in fluid communication with the air plenum and includes a first fan for urging a first flow of air and a second fan positioned adjacent the first fan for urging a second flow of air, wherein a void region is defined immediately downstream of the first fan and the second fan to permit interaction between the first flow of air and the second flow of air.

In another exemplary embodiment, a fan assembly for a cooking appliance is provided. The cooking appliance includes a cabinet, an insulated cooking chamber positioned within the cabinet, and an air plenum defined between the cabinet and the insulated cooking chamber. The fan assembly includes a first fan including a first housing defining a first outlet for directing a first flow of air. The fan assembly further includes a second fan positioned adjacent the first fan and including a second housing defining a second outlet for directing a second flow of air, wherein a void region is defined immediately downstream of the first fan and the second fan to permit interaction between the first flow of air and the second flow of air.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
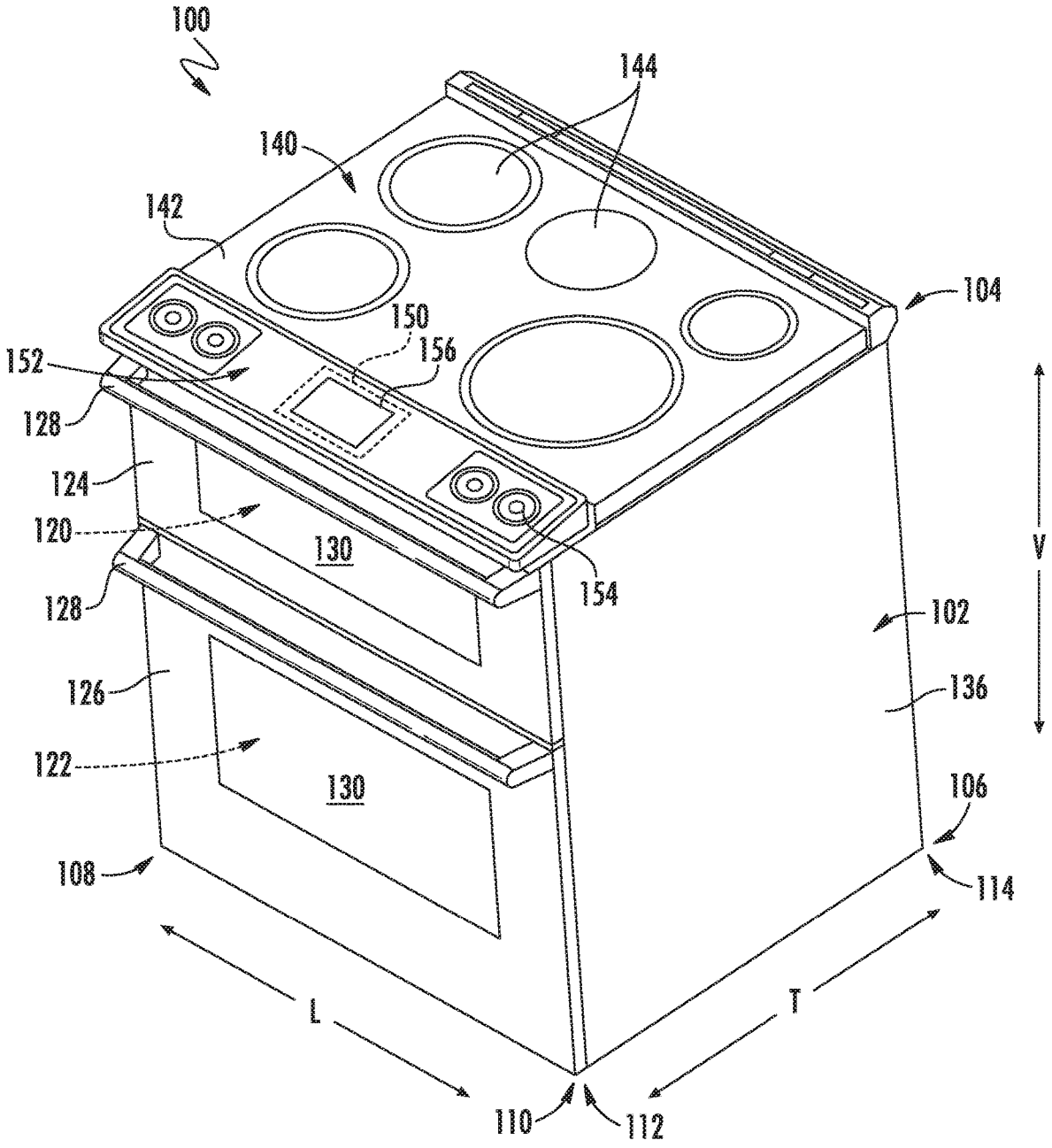
FIG. 1 provides a perspective view of an oven appliance according to an exemplary embodiment of the present subject matter.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
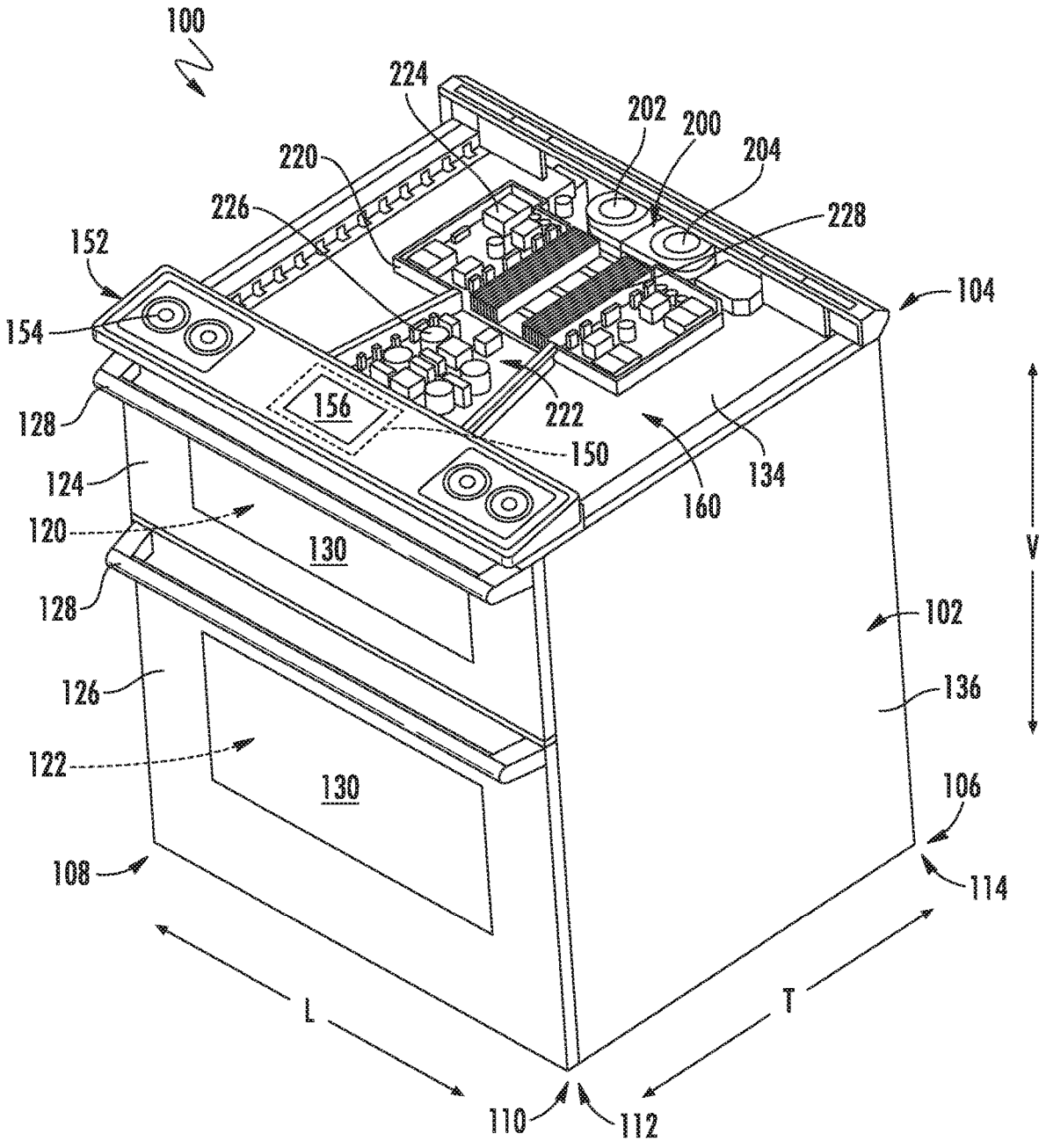
FIG. 2 provides a perspective view of the exemplary oven appliance of FIG. 1 with a top panel removed to reveal internal electronic components.

FIGS. 1 and 2 depict an exemplary oven appliance 100 that may be configured in accordance with aspects of the present disclosure. Specifically, FIG. 1 provides a perspective view of oven appliance 100 according to an exemplary embodiment of the present subject matter. FIG. 2 provides a perspective view with a top panel of oven appliance 100 removed to reveal internal electronic components. As illustrated, oven appliance 100 generally defines a vertical direction V, a lateral direction L, and a transverse direction T, each of which is mutually perpendicular, such that an orthogonal coordinate system is generally defined.

Oven appliance 100 includes an insulated cabinet 102. Cabinet 102 of oven appliance 100 extends between a top 104 and a bottom 106 along the vertical direction V, between a first side 108 (left side when viewed from front) and a second side 110 (right side when viewed from front) along the lateral direction L, and between a front 112 and a rear 114 along the transverse direction T.

Cabinet 102 defines an upper cooking chamber 120 and a lower cooking chamber 122 configured for the receipt of one or more food items to be cooked. Thus, oven appliance 100 is generally referred to as a double oven range appliance. However, as will be understood by those skilled in the art, oven appliance 100 is provided by way of example only, and the present subject matter may be used in any suitable cooking appliance. Thus, the present subject matter may be used with other oven appliances such as wall ovens, electric ovens, gas ovens, microwave ovens, etc. In addition, the example embodiment shown in FIG. 1 is not intended to limit the present subject matter to any particular cooking chamber configuration or arrangement.

Oven appliance 100 includes an upper door 124 and a lower door 126 rotatably attached to cabinet 102 in order to permit selective access to upper cooking chamber 120 and lower cooking chamber 122, respectively. Handles 128 are mounted to upper and lower doors 124 and 126 to assist a user with opening and closing doors 124 and 126 in order to access cooking chambers 120 and 122. As an example, a user can pull on handle 128 mounted to upper door 124 to open or close upper door 124 and access upper cooking chamber 120. Doors 124, 126 may include windows 130, constructed for example from multiple parallel glass panes to provide for viewing the contents of and insulating the insulated cooking chambers 120, 122.

Figure 4:
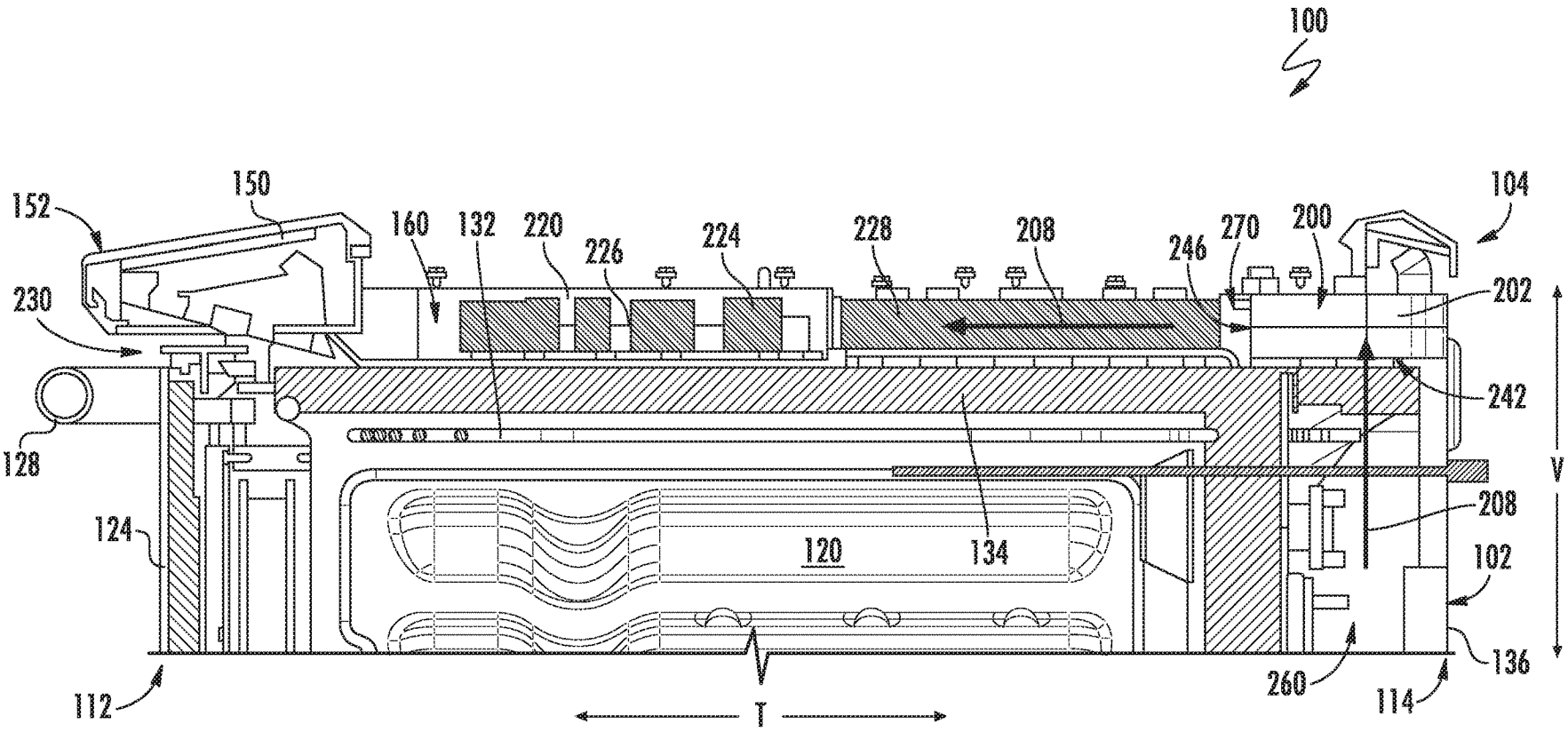
FIG. 4 provides a side, cross sectional view of the exemplary oven appliance of FIG. 1.

Referring now specifically to FIG. 4, heating elements 132, such as electric resistance heating elements, gas burners, microwave heating elements, halogen heating elements, or suitable combinations thereof, are positioned within upper cooking chamber 120 and lower cooking chamber 122 for heating upper cooking chamber 120 and lower cooking chamber 122. One or more baking racks (not shown) may be positioned in insulated cooking chambers 120, 122 for the receipt of food items or utensils containing food items. The baking racks may be slidably received onto embossed ribs or sliding rails such that the baking racks may be conveniently moved into and out of insulated cooking chamber 120, 122 when doors 124, 126 are open.

As illustrated, each of insulated cooking chambers 120, 122 are defined by a plurality of chamber walls 134. For example, insulated cooking chambers 120, 122 each include a top wall and a bottom wall which are spaced apart along the vertical direction V. A left sidewall and a right sidewall extend between the top wall and bottom wall, and are spaced apart along the lateral direction L. A rear wall may additionally extend between the top wall and the bottom wall as well as between the left sidewall and the right sidewall, and is spaced apart from doors 124, 126 along the transverse direction T. In this manner, when doors 124, 126 are in the closed position, cooking cavities are defined.

According to the illustrated embodiment, chamber walls 134 of insulated cooking chambers 120, 122 are depicted as simple blocks of insulating material surrounding the cooking cavity. However, one skilled in the art will appreciate that the insulating material may be constructed of one or more suitable materials and may take any suitable shape. For example, the insulating material may be encased in one or more rigid structural members, such as sheet metal panels, which provide structural rigidity and a mounting surface for attaching, for example, heating elements, temperature probes, rack sliding assemblies, and other mechanical or electronic components.

In a similar manner, cabinet 102 includes multiple panels 136 which enclose insulated cooking chambers 120, 122. For example, cabinet 102 includes a bottom panel, a front panel, a rear panel, a left panel, a right panel, etc. Doors 124, 126 may sit flush against the front panel when in the closed position. According to the illustrated embodiment, panels 136 of cabinet 102 are single ply sheet metal panels, but one skilled in the art will appreciate that any suitably rigid panel may be used while remaining within the scope of the present subject matter. For example, according to an exemplary embodiment, panels 136 may be constructed from a suitably rigid and thermally resistant plastic. In addition, each panel 136 may include multiple layers made from the same or different materials, and may be formed in any suitable shape.

Referring to FIG. 1, oven appliance 100 also includes a cooktop 140. Cooktop 140 is positioned at or adjacent top 104 of cabinet 102. Thus, cooktop 140 is positioned above upper cooking chamber 120 and includes a top panel 142 positioned proximate top 104 of cabinet 102. By way of example, top panel 142 may be constructed of glass, ceramics, enameled steel, and combinations thereof. A plurality of burner assemblies 144 are mounted within or on top of top panel 142. More specifically, according to the illustrated embodiment, cooktop 140 is an induction cooktop and each burner assembly 144 is an induction burner. As shown in FIG. 1, burners assemblies 144 can be configured in various sizes so as to provide e.g., for the receipt of cooking utensils (i.e., pots, pans, etc.) of various sizes and configurations and to provide different heat inputs for such cooking utensils.

Oven appliance 100 is further equipped with a controller 150 to regulate operation of the oven appliance 100. For example, controller 150 may regulate the operation of oven appliance 100 including heating elements 132, burner assemblies 144, etc. Controller 150 may be in communication (via for example a suitable wired or wireless connection) with the heating elements 144 and other suitable components of the oven appliance 100, as discussed herein. In general, controller 150 may be operable to configure the oven appliance 100 (and various components thereof) for cooking. Such configuration may be based on a plurality of cooking factors of a selected operating cycles, sensor feedback, etc.

By way of example, controller 150 may include one or more memory devices and one or more microprocessors, such as general or special purpose microprocessors operable to execute programming instructions or micro-control code associated with an operating cycle. The memory may represent random access memory such as DRAM, or read only memory such as ROM or FLASH. In one embodiment, the processor executes programming instructions stored in memory. The memory may be a separate component from the processor or may be included onboard within the processor.

Controller 150 may be positioned in a variety of locations throughout oven appliance 100. In the illustrated embodiment, controller 150 may be located within a user interface panel or control panel 152 of oven appliance 100 as shown in FIGS. 1 and 2. In such an embodiment, input/output ("I/O") signals may be routed between the control system and various operational components of oven appliance 100 along wiring harnesses that may be routed through cabinet 102. Typically, controller 150 is in communication with control panel 152 and controls 154 through which a user may select various operational features and modes and monitor progress of oven appliance 100. In one embodiment, control panel 152 may represent a general purpose I/O ("GPIO") device or functional block. In one embodiment, control panel 152 may include input components or controls 154, such as one or more of a variety of electrical, mechanical or electro-mechanical input devices including rotary dials, push buttons, and touch pads. Control panel 152 may include a display component, such as a digital or analog display device 156 designed to provide operational feedback to a user.

Control panel 152 may be in communication with controller 150 via one or more signal lines or shared communication busses. Controller 150 may also be communication with one or more sensors, e.g., a temperature sensor that is used to measure temperatures inside insulated cooking chambers 120, 122 and provide such measurements to controller 150. The temperature sensor may be a thermocouple, a thermistor, a resistance temperature detector, or any other device suitable for measuring the temperature within insulated chambers 120, 122. In this manner, controller 150 may selectively control heating elements 144 in response to user manipulation of control panel 152 and temperature feedback from the temperature sensor. Controller 150 can also receive temperature measurements from the temperature sensor placed within insulated chambers 120, 122 and e.g., provide a temperature indication to the user with display 156.

Although aspects of the present subject matter are described herein in the context of a double oven appliance including an induction cooktop, it should be appreciated that oven appliance 100 is provided by way of example only. In this regard, the present subject matter is not limited to any particular style, model, or configuration of oven appliance 100. For example, other oven or range appliances having different configurations, different appearances, and/or different features may also be utilized with the present subject matter as well, e.g., single ovens, electric cooktop ovens, gas cooktops ovens, etc. Moreover, aspects of the present subject matter may be used in any other consumer or commercial appliance where it is desirable to efficiently cool appliance components.

Figure 3:
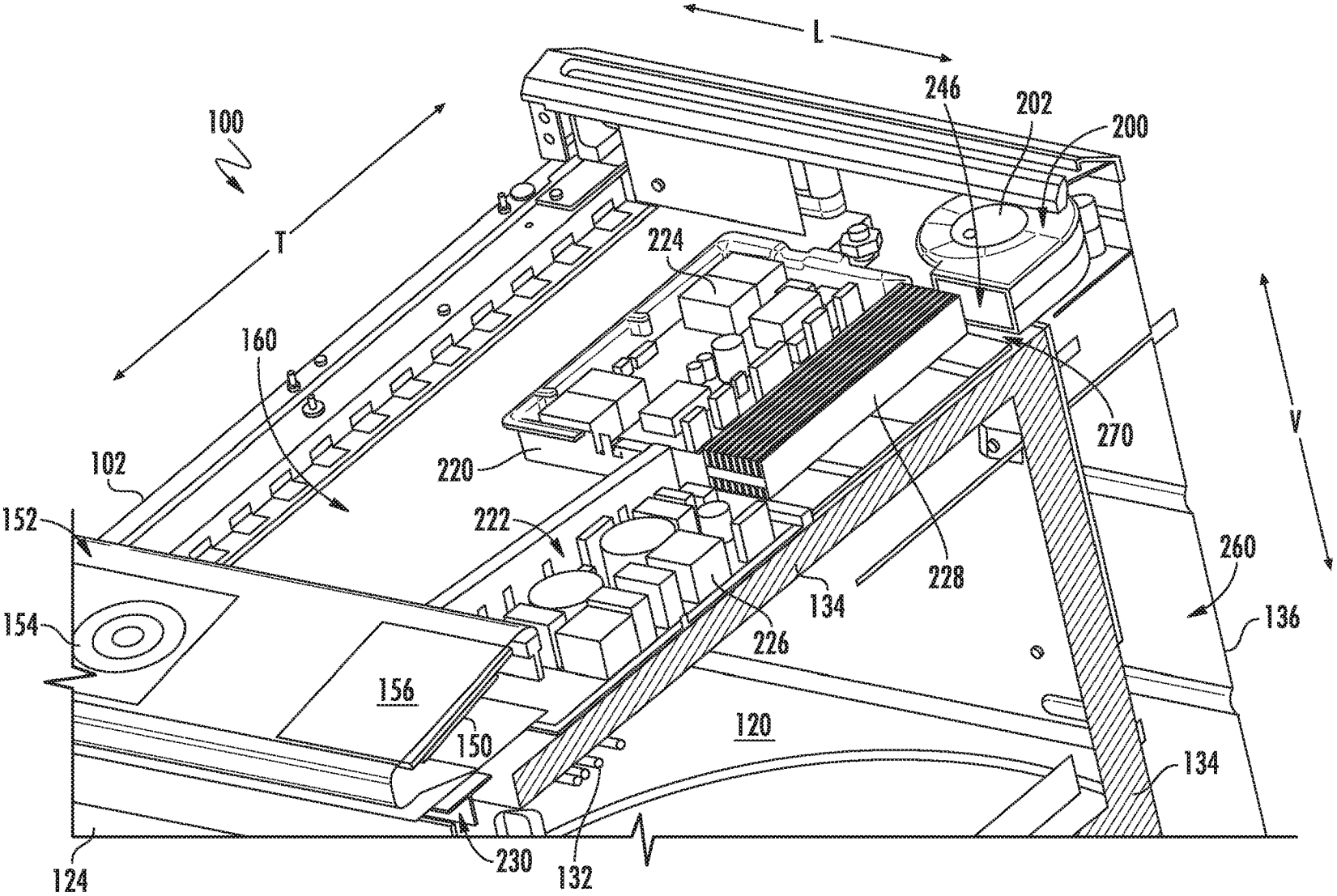
FIG. 3 provides a perspective, cross sectional view of the exemplary oven appliance of FIG. 1.

Referring now generally to FIGS. 2 through 4, insulated cooking chambers 120, 122 are positioned within cabinet 102 such that walls 134 of insulated cooking chambers 120, 122 and panels 136 of cabinet 102 define a variety of air flow passageways between insulated cooking chambers 120, 122 and cabinet 102. These passageways, which may be referred to herein generally as air plenum 160, may generally be configured for housing appliance components and receiving cooling air flow throughout oven appliance 100.

For example, a variety of oven appliance 100 components, such as heating elements and other cooktop components, may be positioned within air plenum 160, which is illustrated in FIGS. 2 through 4 as being defined between top panel 142 and a top wall 134 of upper cooking chamber 122. Air may flow into air plenum 160 through various apertures and/or channels defined by cabinet 102. In this manner, cooler ambient air may flow into cabinet 102 and through air plenum 160, thereby extracting heat from electronic components and other surfaces within oven appliance 100 which may be exhausted from oven appliance 100.

Referring now to FIGS. 2 through 7, a fan assembly 200 which may be used with oven appliance 100 will be described according to an exemplary embodiment of the present subject matter. In general, fan assembly 200 is placed in fluid communication with air plenum 160 and is configured for urging a flow of cooling air through air plenum 160, e.g., to cool electronic components and insulated cooking chambers 120, 122. Although a specific configuration of fan assembly 200 is described herein for use with oven appliance 100, it should be appreciated that aspects of the present subject matter may be used in other appliances, e.g., as part of an appliance cooling system. In addition, modifications and variations may be made to fan assembly 200 while remaining within the scope of the present subject matter.

As illustrated, fan assembly 200 includes a first fan 202 and a second fan 204 mounted to a single fan bracket 206 in a top rear center of cabinet 102. Due to the similarity between first fan 202 and second fan 204, similar reference numerals may be used to refer to the same or similar features on each of first fan 202 and second fan 204. Similarly, although first fan 202 and second fan 204 actually urge separate flows of air, air flow from fan assembly 200 is generally identified using reference numeral 208 in the figures. In general, fan assembly 200 is oriented such that the flow of cooling air 208 is urged along a central flow axis 210 that extends substantially along the transverse direction T. It should be appreciated that as used herein, terms of approximation, such as "approximately," "substantially," or "about," refer to being within a ten percent margin of error.

As best shown in FIGS. 2 and 3, fan assembly 200 is positioned and oriented for cooling various components of oven appliance 100. For example, oven appliance 100 may include an electronics housing 220 which defines an electronics compartment 222 for containing various electronic components 224. For example, electronics housing 220 is illustrated as a rigid plastic tray being positioned within air plenum 160 between cooktop 140 and a top chamber wall 134 of upper cooking chamber 120. Electronics housing 220 may generally be configured for receiving electronic components 224 and defining a flow path for guiding the flow of cooling air 208.

Electronic components 224 positioned within electronics housing 220 may include, for example, a filter board 226 for filtering electrical power before using it to energize induction burners assemblies 144. In addition, electronics housing 220 may include one or more heat exchangers 228 for facilitating heat dissipation. In this regard, for example, exchanger 228 may include extruded aluminum heat sinks with heat exchange fins extending substantially along the transverse direction T such that the flow of cooling air 208 passes through heat exchangers 228 for removing heat and lowering the temperature within the electronics compartment 222. Specifically, as illustrated, the flow of cooling air 208 generally flows along central flow axis 210 and two heat sink heat exchangers 228 that are spaced apart on opposite lateral sides of central flow axis 210. In this manner, a large portion of the flow of cooling air 208 may pass in between heat exchangers 228, e.g., to cool filter board 226 and control panel 152.

In addition, the flow of cooling air 208 may pass underneath or through control panel 152 to cool electronics components housed therein. Specifically, the flow of cooling air may pass along the transverse direction T through electronics housing 220 to control panel 152 where it may cool electronics housed within control panel 152 before being discharged through an exhaust vent 230 defined in front panel 136 of cabinet 102. Although the flow of cooling air 208 is illustrated as being urged forward along the transverse direction and out exhaust vent 230 defined at front 112 of cabinet 102, it should be appreciated that other airflow directions, inlets, and outlets may be used while remaining within the scope of the present subject matter. For example, the airflow may be reversed, may be drawn from another location, and may be exhausted at any suitable location on cabinet 102.

According to the illustrated embodiment, first fan 202 and second fan 204 are centrifugal or radial fans. In this regard, first fan 202 includes a first housing 240 defining a first intake 242, a first volute 244, and a first outlet 246. During operation, the drum shaped impeller 248 is rotated to draw the flow of cooling air 208 into first housing 240 through first intake 242. Impeller 248 then urges the flow of air 208 outward along a radial direction against first volute 244 before discharging the flow of cooling air 208 through first outlet 246. Similarly, second fan 204 includes a second housing 250 defining a second intake 252, a second volute 254, and a second outlet 256. Second fan 204 operates in a similar manner to first fan 202. Although illustrated as centrifugal or radial fans, it should be appreciated that according to alternative embodiments, fan assembly 200 may include any suitable number, type, and configuration of fans.

According to the illustrated embodiment, first fan 202 and second fan 204 are mounted to a sheet metal fan bracket 206, e.g., using mechanical fasteners, glue, snap-fit mechanisms, etc. However, it should be appreciated that according to alternative embodiments, first fan 202 and second fan 204 may be manufactured as a single assembly including two fans within separately defined fan housings/volutes. Specifically, for example, first housing 240 and second housing 250 may be molded as a single piece and define two fan housings defining separate outlets and being configured for receiving separate fan impellers. In this manner, the manufacturing and assembly of fan assembly 200 may be simplified.

Figure 5:
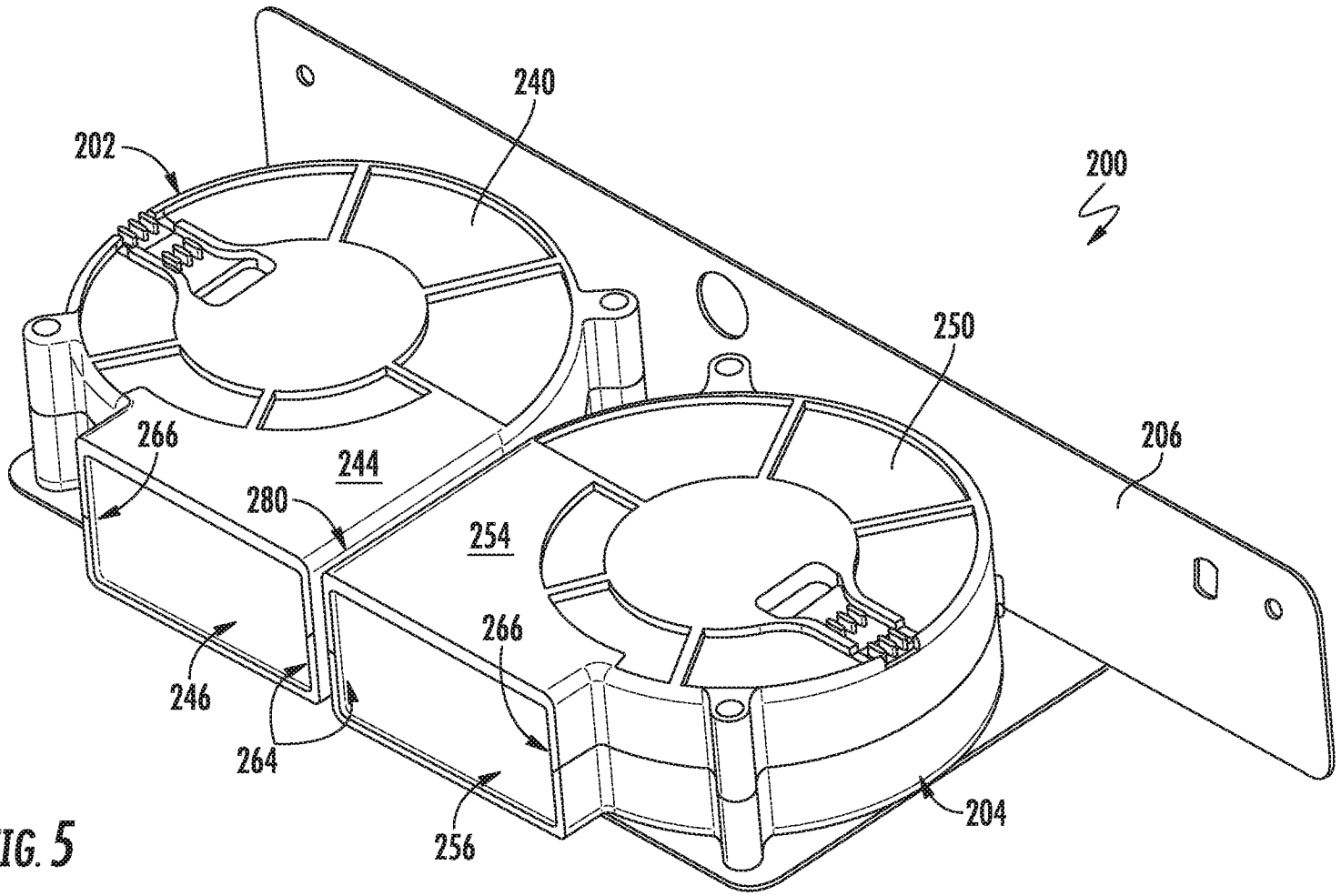
FIG. 5 provides a perspective view of a fan assembly that may be used to cool components of the exemplary oven appliance of FIG. 1.
Figure 6:
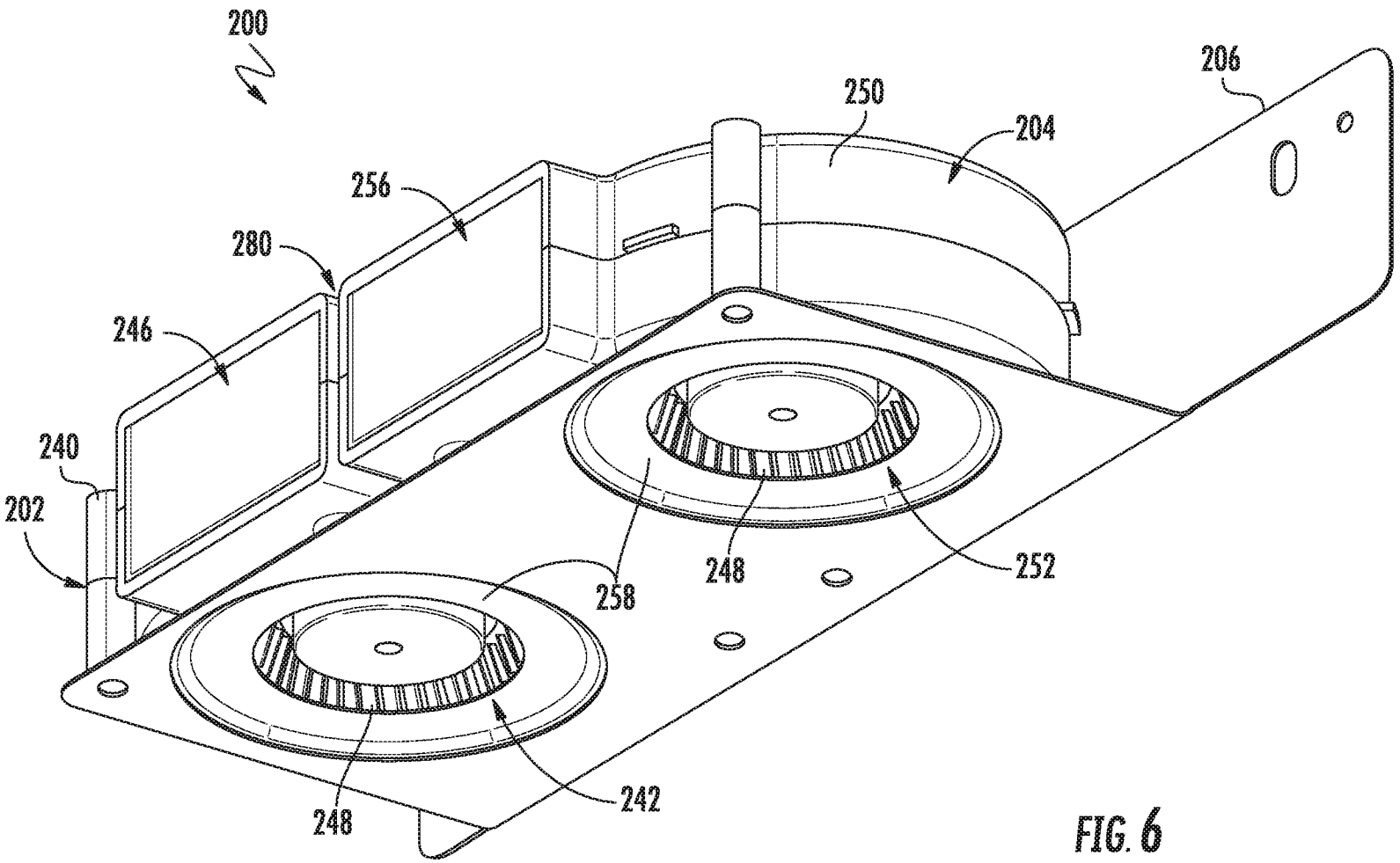
FIG. 6 provides a bottom, perspective view of the exemplary fan assembly of FIG. 1.
Figure 7:
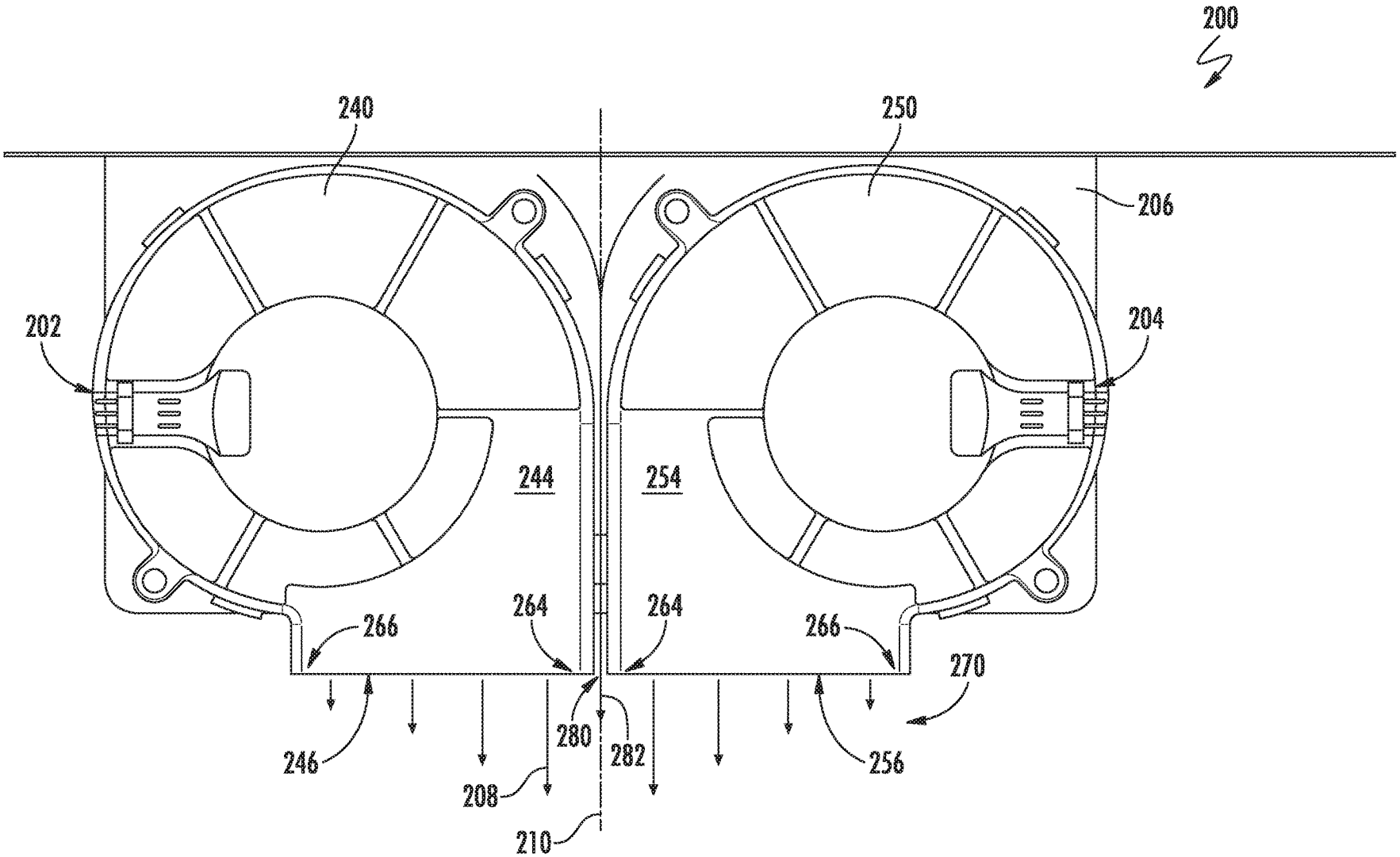
FIG. 7 provides a top view of the exemplary fan assembly of FIG. 1.

As best illustrated in FIGS. 5 through 7, first fan 202 and second fan 204 are positioned adjacent each other and oriented such that the flow of cooling air 208 is directed substantially along the same direction (e.g., along the transverse direction T or along central flow axis 210) out of outlets 246, 256. In this regard, for example, fan assembly 200 may be symmetric about central flow axis 210 which extends between first fan 202 and second fan 204. In addition, first fan 202 and second fan 204 may be a mirror images of each other, such that first intake 242 and second intake 252 are both defined on a bottom wall 258 of the respective housings 240, 250 while first volute 244 and second volute 254 define outlets 246, 256 adjacent each other.

More specifically, as best shown in FIGS. 3 and 4, oven appliance 100 may define a rear plenum 260 between a rear wall 134 of cooking chamber 120, 122 and a rear panel 136 of cabinet 102. Various inlets may be defined within rear panel 136 and/or side panels of cabinet 102 for permitting fresh air to flow into cabinet 102. Fans 202, 204 may draw the flow of cooling air 208 up through rear plenum 260 into first intake 242 and second intake 252. The flow of cooling air 208 may then be urged forward along central flow axis 210, e.g., to cool electronic components 224 within electronics compartment 222.

Notably, centrifugal fans such as first fan 202 and second fan 204 generally define a high velocity side 264 and a low velocity side 266 at their respective outlets 246, 256. Specifically, due to the configuration of impeller 248 for urging the flow of air 208 outward along the radial direction and against volutes 244, 254, the flow of cooling air 208 has a higher velocity at the radially outer edge of volutes 244, 254 and outlets 246, 256. By contrast, the radially inner sides of outlets 246, 256 generally define the low velocity side 266. In other words as the blades of impeller 248 rotate, the air at the edge farthest from the axis of rotation moves faster than the air at the edge closest to the axis of rotation such that the velocity profile at outlets 246, 256 is nonlinear. As illustrated, high velocity sides 264 of first fan 202 and second fan 204 are positioned adjacent each other while low velocity sides 266 are separated from each other. The fan orientation and a schematic representation of the velocity of the flow of cooling air 208 are illustrated in FIG. 7.

As a result of the nonlinear velocity profile at outlets 246, 256, more air exits on high velocity side 264 of outlets 246, 256. As the flow of cooling air 208 exits outlets 246 256, it may undergo rapid expansion resulting in significant expansion losses. These expansion losses are proportional to velocity, so more losses are seen on high velocity side 264. However, positioning and orienting first fan 202 and second fan 204 as described herein can minimize losses on high velocity side 264 by permitting the flow of air 208 to interact downstream of outlets 246, 256. It should be appreciated that the terms "upstream" and "downstream" refer to the relative direction with respect to fluid flow in a fluid pathway. For example, "upstream" refers to the direction from which the fluid flows and "downstream" refers to the direction to which the fluid flows.

In this regard, for example, fan assembly 200 may define a void region 270 immediately downstream of first fan 202 and second fan 204 to permit interaction between the flow of air 208 exiting outlets 246, 256. As used herein, "void region" is used to refer to an open space within air plenum 160 that contains no appliance components or features for substantially disturbing or segregating the flow of air 208. In this regard, for example, void region 270 is a space between outlets 246, 256 and heat exchangers 228 within which there are no baffles, flow guiding features, or other components. Notably, permitting the flow of air 208 exiting first fan 202 and second fan 204 to interact within void region 270 significantly lowers expansion losses at outlets 246, 256, thus improving efficiency a fan assembly 200.

According to an exemplary embodiment of the present subject matter, first housing 240 and second housing 250 may be in direct contact with each other proximate outlets 246, 256. In such an embodiment, efficiency losses may be decreased and smaller fans may be used while achieving the same airflow as larger fans, thus minimizing the footprint of fan assembly 200 and the associated cost of operation.

According to the illustrated embodiment, first housing 240 and second housing 250 may be separated by an airgap 280 proximate to first outlet 246 and second outlet 256. In this regard, for example, airgap 280 may be any spacing (e.g., along the lateral direction L) between first housing 240 and second housing 250 sufficient to permit a flow of entrainment air 282 (see FIG. 7) to pass through airgap 280 and mix with the flow of air 208. For example, according to the illustrated embodiment, airgap 280 is less than about 0.25 inches, though other suitable sizes are possible and within the scope of the present subject matter.

Notably, positioning first fan 202 and second fan 204 such that airgap 280 is defined therebetween generates a Venturi effect that draws in entrainment air 282 to increase the total amount of air urged by fans 202, 204 while also minimizing efficiency losses due to expansion at outlets 246, 256. For example, the total airflow 208 and entrainment air 282 may be greater than 15% more than the sum of the flow rates of first fan 202 and second fan 204 when operating separately. As a result, fan assembly 200 may have a smaller footprint, may operate more efficiently, and may maintain regulate appliance temperatures as desired.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A cooking appliance defining a vertical direction, a lateral direction, and a transverse direction, the cooking appliance comprising:

a cabinet;

an insulated cooking chamber positioned within the cabinet;

an air plenum defined between the cabinet and the insulated cooking chamber; and a fan assembly in fluid communication with the air plenum, the fan assembly comprising:

a first fan rotating about a first axis for urging a first flow of air, the first fan comprising a first housing defining a first outlet; and a second fan positioned adjacent the first fan and rotating about a second axis that is spaced apart from and parallel to the first axis, the second fan rotating in an opposite direction of the first fan for urging a second flow of air, the second fan comprising a second housing defining a second outlet, wherein a void region is defined immediately downstream of the first fan and the second fan to permit interaction between the first flow of air and the second flow of air, and wherein the first housing and the second housing are separated by an airgap proximate the first outlet and the second outlet.

2. The cooking appliance of claim 1, wherein the first outlet and the second outlet are oriented for directing the first flow of air and the second flow of air along substantially the same direction.

3. The cooking appliance of claim 1, wherein each of the first outlet and the second outlet has a high velocity side and a low velocity side, the high velocity sides of the first outlet and the second outlet being positioned adjacent each other.

4. The cooking appliance of claim 1, wherein the airgap is less than about 0.25 inches.

5. The cooking appliance of claim 1, wherein the fan assembly is symmetric about a central flow axis that extends between the first fan and the second fan.

6. The cooking appliance of claim 1, wherein the first fan and the second fan are centrifugal or radial fans.

7. The cooking appliance of claim 1, wherein the first fan and the second fan each comprise a bottom wall defining a fan intake.

8. The cooking appliance of claim 7, wherein the fan intake receives a flow of intake air from a rear plenum defined between the insulated cooking chamber and a rear of the oven appliance.

9. The cooking appliance of claim 1, wherein the first fan and the second fan are positioned proximate a rear of the oven appliance and direct the first flow of air and the second flow of air forward substantially along the transverse direction.

10. The cooking appliance of claim 9, wherein the electronics compartment comprises:

at least two heat exchangers, the two heat exchangers being spaced apart on opposite sides of a central flow axis of the fan assembly.

11. The cooking appliance of claim 10, wherein the two heat exchangers are spaced apart by a flow path, and wherein a portion of each of the first flow of air and the second flow of air passes through the flow path between the two heat exchangers.

12. The cooking appliance of claim 1, comprising:

an electronics compartment positioned downstream from the first fan and the second fan and including a plurality of electronic components, wherein the first fan and the second fan urge the first flow of air and the second flow of air through the electronics compartment.

13. The cooking appliance of claim 1, comprising:

a control panel positioned proximate a top and a front of the cabinet, the first flow of air and the second flow of air passing through the control panel and discharging through an exhaust vent.

14. The cooking appliance of claim 1, wherein the cooking appliance is an induction cooktop and the first flow of air and the second flow of air are directed through a filter board of the induction cooktop.

15. The cooking appliance of claim 1, wherein the airgap is in fluid communication with an air plenum for receiving a flow of entrainment air.

16. A fan assembly for a cooking appliance, the cooking appliance comprising a cabinet, an insulated cooking chamber positioned within the cabinet, and an air plenum defined between the cabinet and the insulated cooking chamber, the fan assembly comprising:

a first fan comprising a first housing defining a first outlet and rotating about a first axis for directing a first flow of air; and a second fan positioned adjacent the first fan and comprising a second housing defining a second outlet, the second fan rotating about a second axis that is spaced apart from and parallel to the first axis, the second fan rotating in an opposite direction of the first fan for directing a second flow of air, wherein a void region is defined immediately downstream of the first fan and the second fan to permit interaction between the first flow of air and the second flow of air, and wherein the first housing and the second housing are separated by an airgap proximate the first outlet and the second outlet.

17. The fan assembly of claim 16, wherein the fan assembly is symmetric about a central flow axis that extends between the first fan and the second fan.

18. The fan assembly of claim 16, wherein the first fan and the second fan are centrifugal or radial fans.

19. The fan assembly of claim 16, further comprising:

at least two heat exchangers, the two heat exchangers being spaced apart on opposite sides of a central flow axis of the fan assembly to form a flow path, and wherein a portion of each of the first flow of air and the second flow of air passes through the flow path.

20. The fan assembly of claim 16, wherein the airgap is in fluid communication with an air plenum for receiving a flow of entrainment air.

* * * * *